US005904820A

United States Patent [19]

Brown et al.

[11] Patent Number: 5,904,820

[45] Date of Patent: May 18, 1999

[54] HOLDING CLAMP FOR ELECTROPLATING ARTICLES

[76] Inventors: Howard Brown, 16 St-Joachim, Pointe-Claire, Quebec, Canada, H9S 4P1; Horst Mallok, 185 Lapalme Street, Ville St-Laurent, Quebec, Canada, H4L 2K3

[21] Appl. No.: 08/983,457

[22] PCT Filed: May 23, 1997

[86] PCT No.: PCT/CA97/00350

§ 371 Date: Jan. 13, 1998

§ 102(e) Date: Jan. 13, 1998

[87] PCT Pub. No.: WO97/46740

PCT Pub. Date: Dec. 11, 1997

Related U.S. Application Data

[60] Provisional application No. 60/018,868, May 30, 1996.

[51] Int. Cl.[6] ..... C25D 17/06

[52] U.S. Cl. ..... 204/225; 204/242; 204/279; 204/297 R

[58] Field of Search ..... 204/279, 297 R, 204/225, 242

[56] References Cited

U.S. PATENT DOCUMENTS

| | | | |
|---|---|---|---|
| 1,773,042 | 8/1930 | Jones | 204/297 R |
| 4,501,650 | 2/1985 | Maron | 204/297 R |
| 4,844,779 | 7/1989 | Callahan | 204/279 X |
| 5,456,814 | 10/1995 | Metzka | 204/297 R |

*Primary Examiner*—Donald R. Valentine
*Attorney, Agent, or Firm*—F. Martineau

[57] ABSTRACT

The holding clamp of the invention has a first elongated arm and a second shorter arm both being electrically conducting and interconnected in parallel spaced-apart fashion by a transverse pivotal bracket intermediate their lengths. The first elongated arm is fixedly attached at its upper end to a cathode frame bar and downwardly depends therefrom. A lever pivotally attached to the first arm intermediate the cathode bar and the pivotal bracket engage the upper end of the second arm in clamming fashion to forcibly tilt same between a first limit position, in which the lower ends of the two arms are spaced-apart, and a second limit position, in which the arms lower ends abut one another under the action of coil springs. The lower ends of the arm members form a pair of jaws provided with electrically conducting studs engageable axially to one another, the studs and arms lower ends being otherwise enveloped with a fluid-tight and electrically insulating sleeve, except at the studs outer free ends. Coil springs straddling the two arms between the pivotal bracket and the lever mount bias the jaws forcibly toward one another. An article to be electroplated is to be sandwiched between the electrically conducting studs outer free ends, under bias from the coil springs, to be submerged in an acid solution bath and electroplated therein.

15 Claims, 5 Drawing Sheets

HOLDING CLAMP FOR ELECTROPLATING ARTICLES

This application claims the benefit of U.S. provisional application No. 60/018,868 was filed May 30, 1996. This is a National Stage Application of PCT/CA97/00308 filed May 23, 1997.

FIELD OF THE INVENTION

The present invention relates to a clamp for holding articles such as plates or the like, and more particularly to a clamp for holding printed circuit boards in an electroplating acid bath.

BACKGROUND OF THE INVENTION

It is known in the art of electroplating to use frames on which are removably anchored plates or the like articles to be plated, for holding them while they are being submerged in large acid tanks or baths, e.g. for creating circuit boards. The acid bath is one of several steps involved in the manufacture of a printed circuit board. The acid solution is usually either chloridric acid or sulfuric acid. The overhanging frames are made of an electrically conducting material sealed in a fluid-tight and electrically insulating material to substantially slow down the corrosive effects of the acidous vapors from the bath of acid, and are sealingly electrically connected to the articles to be plated. The frames are connected to a cathode element, or flight bar, and are subjected to an electrical current which is transmitted through the frame structure, the article and the liquid acid. An anode element is also submerged in the acid bath, spaced 6 to 10 inches from the circuit board. The potential difference between the article and the reducing agent anode element allows the metal composing the latter to migrate and attach itself onto the article. The metal composing the anode element can be for example copper, or any other suitable material combining a proper oxydo-reduction potential and suitable conductive characteristics.

A device as generally described above is disclosed in Canadian patent No. 1,215,939 issued Dec. 30, 1986, with two of the three joint inventors therein being the two joint inventors of the present patent application. The device of the '939 patent indeed comprises a large frame on which can be sealingly bolted a number of articles to be plated, as shown in FIG. 3 of this patent. The electrical current is transmitted through the threaded shaft in FIG. 3, the shaft engaging a bore in the article to be plated and thus conducting the electrical current through this engagement. An electrical insulator covers the plate holding member and the article is thus sealingly engaged on both sides around the electrically conductive threaded shaft.

The device according to the '939 patent comprises three main disadvantages. Firstly, the article to be plated has to be bored therethrough to accommodate the threaded shaft therein. Without this through bore, the article cannot be held by the rack in the acid bath. Secondly, the nut head portion 50 of the holding bolt has to be manually screwed into place and manually removed to install/retrieve the article. This can be a very time-consuming operation, since there can be many such bolts on a single rack as shown in FIG. 1, and moreover there can be many such racks being submerged into the acid baths. Also, screwing/removing an important number of nut heads often results in wrist pain for the worker and can and do lead to claims for insurance disability coverage. Thirdly, the nut head portion of the holding bolt is submerged in the acid bath and then has to be directly manipulated to remove the plated article therefrom. Since the acid bath comprises a poisonous and dangerous liquid, it is clearly not desirable to manipulate directly these nut heads; protective gloves or the like have to be used, and these gloves can become cumbersome and backward in removing the small nut head.

Another invention is shown in U.S. Pat. No. 2,190,440 issued in 1940 to W. Beebe, wherein a rectangular frame holds a number of inwardly oriented clamp members illustrated in FIG. 3. The clamp members have an electrically conductive fixed jaw and an insulative jaw that are biased into a closed position, over the article to be plated, thus holding the latter at the center of the frame. The electrically conductive jaw is sealingly and conductingly connected to the article, but is otherwise covered by an insulative layer. The two jaws are biased into a closed position by means of elastic rubber bands linking them.

The device disclosed in the Beebe patent comprises three important disadvantages. Firstly, the dimension of the whole frame has to be modified to accommodate articles (plates, in this case) of different sizes. This can be highly time-consuming, and is of course not desirable. Secondly, the small clamp members are submerged in the dangerous liquid acid bath, and then have to be manipulated directly to allow the plate to be retrieved. Thus, gloves or other protective gear have to be worn, effectively reducing the preciseness of the manipulation and being cumbersome in operating the small clamp members. Thirdly, four clamps have to be operated to install/remove a single plate from the frame, significantly increasing the time to accomplish these operations.

OBJECTS OF THE INVENTION

It is an important object of this invention to provide an article holding device that allows the user to manipulate the device directly, without the need for protection gear, when operating said device.

It is another object of this invention that the holding device be easy and quick to operate.

It is another object of this invention that the holding device require only one operation for installing or retrieving an article therefrom.

SUMMARY OF THE INVENTION

The present invention relates to a clamp for holding printed circuit boards in an electroplating acid bath.

More particularly, the invention is a holding clamp, for releasably holding an article to be submerged in a liquid solution bath ahead of a submerged anode bar and to be electroplated therein, said holding clamp destined to downwardly depend from an overlying cathode frame bar, said holding clamp comprising:

a) a first and a second elongated arm members made of an electrically conducting material and each defining a lower portion coated with a fluid-tight and electrically insulating sleeve, and an upper and a lower end, said first arm member to be fixedly attached to the cathode frame bar at its upper end, said second arm member being shorter than said first arm member and being pivotally attached to said first arm member and being pivotable between a first limit position in which said lower ends are spaced from one another and a second limit position in which said lower ends abut against one another, said first arm member having electrical current conduction means physically accessible at its lower end;

b) biasing means, for biasing said arm members lower ends against one another;

c) a lever member, pivotally attached to an intermediate section of said first arm member and located entirely above said first and second arm member sleeves at all times, said lever member selectively forcibly pivotally biasing said second arm member into said first limit position against the action of said biasing means;

wherein said first and second arm members are destined to frictionally hold the article to be electroplated between their lower ends when said second arm member is in its second limit position, thus allowing current to be conducted through said conduction means into said article, with said first and second arm member lower portions destined to be submerged in the solution at the most partially up their sleeves.

Preferably, said conduction means includes at least a first terminal stud having an electrically conducting core defining a first and a second end, said core first end extending through said first arm member sleeve and being electrically connected to said first arm member electrically conducting material, said terminal stud further having a fluid-tight and electrically insulating washer member snugly sealing said core except at said first and second ends, with said washer member axially extending beyond said second end and being destined to be sealingly axially compressed against the article when said second arm member is in said second limit position, but allowing said stud core second end to engage said article for electrical connection therebetween.

Advantageously, said second arm member further includes a second cylindrical stud axially registering with said first stud when said second arm member is in said second limit position, with said second stud having an outer washer member to be axially compressed against the article when said second arm member is in said second limit position.

Preferably, said first stud is cylindrical and has a corrosion-resistant film coating its cylindrical surface under said washer member.

Advantageously, said first and second arm members are pivoted by means of a first mount fixedly attached to said first arm member above said sleeve, said second arm member being pivotally attached to said pivoting mount spaced from said first arm member, said biasing means being at least one coil spring compressed between and attached to intermediate sections of said first and second arm members, said coil spring being located between said first mount and said first and second arm member upper ends.

Advantageously, said lever defines a first and a second end and is attached to said first arm member by means of a second mount fixed to said first arm member, with said lever being pivotally attached to said second mount spaced from said first arm member and at a location intermediate said lever first and second ends, said lever being pivotable between a lower and an upper limit position corresponding to said second arm member first and second limit position, respectively, said lever second end lying freely adjacent said second arm member in its upper limit position and pivotally abutting against said second arm member above said at least one coil spring when pivoted into its lower limit position.

In a preferred embodiment of the invention, said first arm member further has several first terminal studs and said second arm member has an equal number of second terminal studs each coaxially engaging with a corresponding first stud when said second arm member is in its said second limit position.

DETAILED DESCRIPTION OF THE PREFERRED EMBODIMENTS

Figure 1:
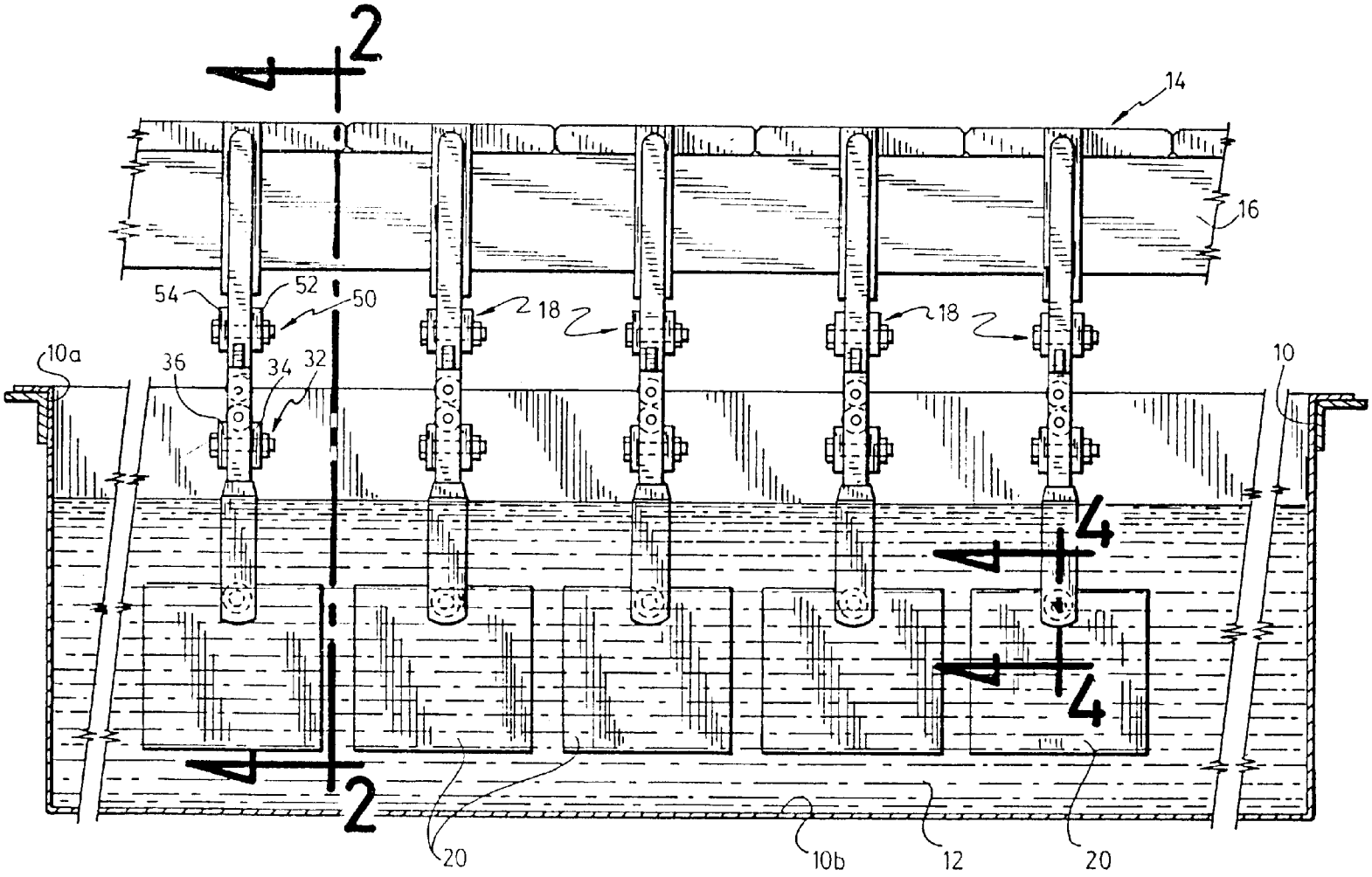
FIG. 1 is a front elevational sectional view of an acid bath showing an overhanging horizontally supported cathode bar holding a number of dowardly depending holding clamps supporting circuit boards to be electroplated according to a first embodiment of the invention.

FIG. 1 shows a liquid solution bath or tank 10, with a top mouth 10*a* and a bottom wall 10*b* and which contains an acid solution 12. A frame 14 overhangs the top mouth 10*a* of acid tank 10. Frame 14 comprises a flight bar acting as a negatively charged cathode bar 16. From cathode bar 16 downwardly depend a number of holding clamps 18 according to a first embodiment of the invention, and illustrated in FIGS. 1 to 8. Holding clamps 18 are each adapted to hold an article 20 to be electroplated, usually of a flat rectangular plate as shown in the drawings, through mouth 10*a* and into acid batch 10 but spacedly over the bottom wall 10*b* of the tank 10.

Frame 14 is movable between a lower and an upper limit position, as known in the art. In its upper limit position, the articles 20 clear the mouth 10*a* of the acid bath 10 and the acid 12, while in its lower limit position, the clamps 18 extend through mouth 10*a* and the articles 20 are entirely submerged into the acid 12 but spacedly over bottom wall 10*b*. At least one positively charged anode element (not shown in FIGS. 1 to 8 of the first embodiment, but illustrated as reference 130 in FIG. 10 of the second embodiment) is located on each side of each article, facing each of the two flat surfaces thereof. When powering means (not shown) are activated, a potential difference is generated between the cathode element and the anode element, and current is transmitted from the anode element through the acid in the bath, the article, the holding clamp (in a manner which will be explained hereinafter) and to the cathode bar. This way, the positively charged ions composing the metallic (copper, gold or another suitable metal) anode element are conveyed by the acid solution—being used as a carrier means—and fix themselves to the article 20 outer surface, thus effectively electroplating article 20.

Figures 2, 3, 4, 5, 6, 7, 8:
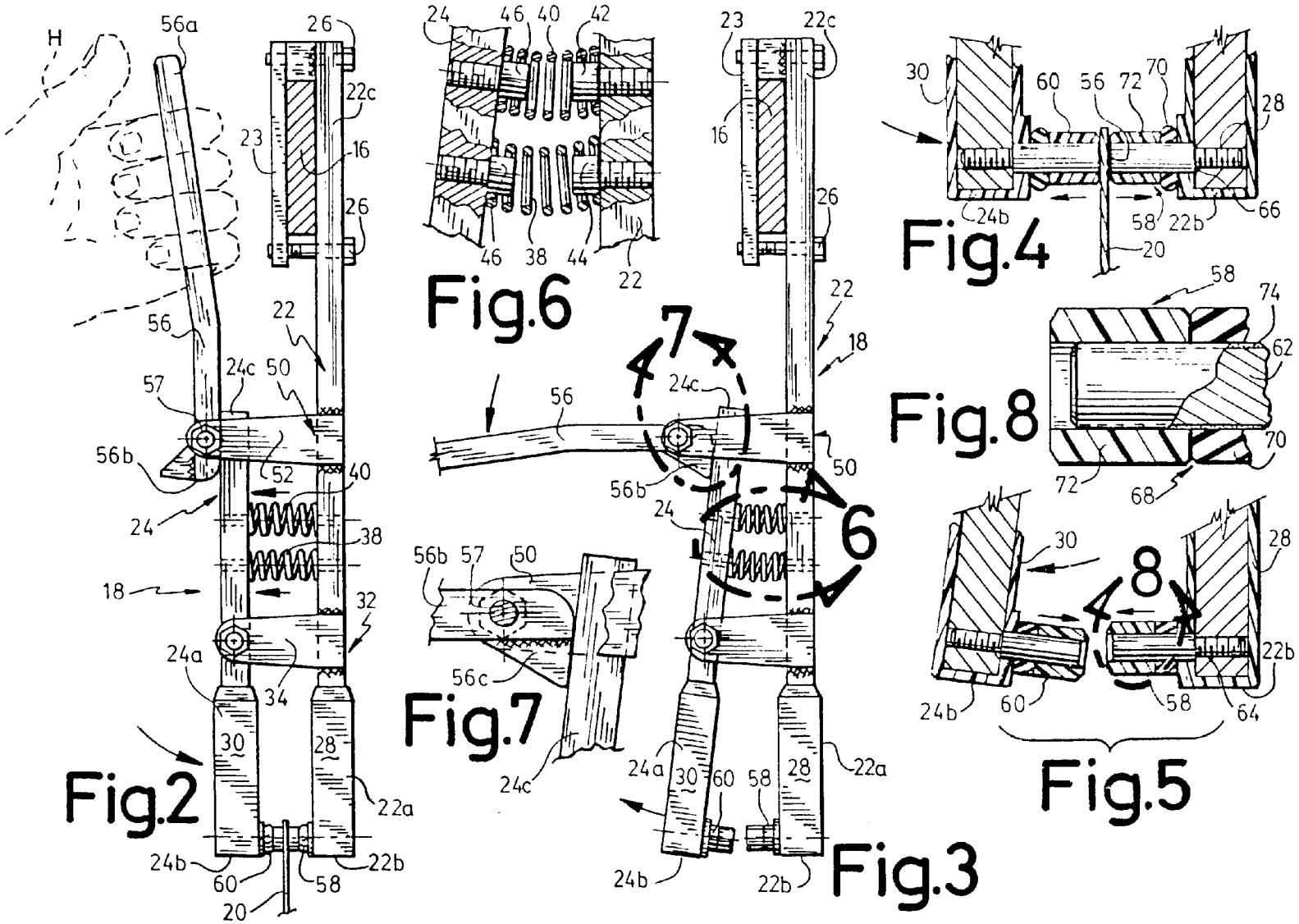
FIG. 2 is an enlarged cross-sectional view across the flight bar, taken along line 2—2 of FIG. 1, showing in full lines a holding clamp with its jaws closed upon an article plate to be plated, with the plate being broken for clarity of the view, and further showing in phantom lines the grip of a user's hand upon the clamp lever.
FIG. 3 is a view similar to FIG. 2, but showing the jaws in an opened position after pivotal action of the central lever under manual bias from the operator.
FIG. 4 is a cross-sectional view of the jaws, at an enlarged scale, taken along line 4—4 of FIG. 1, with the jaws of the clamp closed upon an article to be plated, the article being only partly illustrated.
FIG. 5 is a view similar to FIG. 4, but showing the jaws in their opened position in which they become spread apart whereby the circuit board can be released.
FIGS. 6 and 7 are enlarged views of the areas circumscribed by ellipses 6 and 7, respectively, of FIG. 3.
FIG. 8 is an enlarged view of the stud circumscribed by ellipse 8 of FIG. 5.

Holding clamp 18 is illustrated in FIGS. 2 to 8. FIGS. 2 and 3 show that holding clamp 18 comprises a first and a second arm member 22, 24 which are interconnected in substantially parallel fashion to one another, with second arm member 24 being much shorter than first arm member 22. First arm member 22 is fixedly anchored at its upper end portion 22*c* to cathode bar 16 preferably by means of through-bolts 26, with the flight bar 16 being taken in sandwich between arm portion 22*c* and an opposite support plate 23 through which the bolts 26 also extend, wherein electrical conduction between elements 22*c* and 16 is ensured.

First and second arm members 22, 24 are made of an electrically conducting material, e.g. metal, and each define a lower portion 22*a*, 24*a* which is covered by a corrosion-resistant, fluid-tight and electrically insulating protective sleeve 28, 30 (FIGS. 2 to 5). Lower arm portions 22*a*, 24*a* must be long enough to allow only the sleeves 28, 30 of the holding clamp 18 to be submerged in the acid 12, so as to prevent the acidic liquid from contacting the arm members metallic material and corrode the latter above sleeves 22, 24.

A first mount 32 consists of two parallel plates 34, 36 (FIGS. 1 and 2) which are fixedly and transversely anchored (e.g. welded as shown in the drawings) on opposite sides of first arm member 22 closely above sleeve 28. First mount 32 pivotally holds second arm member 24 spaced from first arm member 22, the pivotal support of mount 32 being located closely above sleeve 30. Thus, second arm 24 can pivot relative to first arm 22 between a first limit position in which the lower end portions 22*b*, 24*b* of first and second arm members 22, 24 are spaced from one another and arm members 22, 24 are substantially parallel to one another, and a second limit position in which lower end portions 22*b*, 24*b* abut one another.

At least one coil spring, e.g. two coil springs 38, 40 as shown in the drawings, are transversely mounted between and fixedly attached and compressed between first and second arm members 22, 24, above first mount 32, so as to bias said second arm member towards its second limit position. As shown in FIG. 6, coil springs 38, 40 are held by means of guide pins 42, 44, 46, 48 which screwingly engage complementary threaded bores in first and second arm members 22, 24. Of course, other suitable biasing means could be used instead of coil springs for biasing second arm member 24 towards its second limit position, e.g. leaf springs, spring bands, resilient rubber members or the like compression biasing means.

A second mount 50 consists of a pair of parallel plates 52, 54 (FIG. 1) which are fixedly and transversely anchored (e.g. welded as illustrated in the drawings) on opposite sides of first arm 22 above coil springs 38, 40. Second mount 50 pivotally carries a lever 56 at pivot axle 57 and spaced from first arm member 22, lever 56 extending with its first upper end 56*a* in a generally upright position well above mount 52, and with its second lower cam end portion 56*b* slightly beneath mount 52 and sidewisely engaging the exterior lateral side of arm portion 24*c*. The upper portion of lever 56 is slightly elbowed away from cathode bar 16, so as to clear the latter to allow an easier grip on lever 56 by a user's hand H (FIG. 2), without the cathode bar being in the way. Lever 56 is pivotable between an upper limit position shown in FIG. 2, in which lever 56 is substantially parallel to first and second arm members 22, 24, and a lower limit position shown in FIG. 3, in which lever 56 is substantially at a right angle relative to first arm member 22 and pivotally abuts on—and slidingly engages with its second end 56*b*—the upper end 24*c* of second arm member 24. As shown in FIG. 7, the second cam end portion 56*b* of lever 56 is curved so as to slidingly engage the flat exterior lateral side surface of arm member 24, and comprises a tangentially-extending finger 56*c* destined to flatly abut against second arm member 24 when lever 56 reaches its lower limit position, thus providing locking engagement that effectively prevents lever 56 from accidentally pivoting downwardly any further than its second horizontal limit position.

Arm members 22, 24 are equipped at their lower end portions 22*b*, 24*b* with transverse inturned cylindrical and integral first and second terminal stud 58 and 60 respectively. Studs 58, 60 axially register with one another when second arm member 24 is in its second limit position. First stud 58 will hereafter be described, but it is understood that second stud 60 is identical, though it is fixed to second arm member 24. Stud 58 comprises a rigid and electrically conducting core 62 (FIG. 8) defining a first and a second end portion 64 and 66, with the core threaded first end portion 64 extending through first arm member sleeve 28 and being of substantially same length that the latter and threadingly engaging the electrically conducting material of arm member 22. On core 62 is peripherally installed a fluid-tight and electrically insulating washer member 68, the latter preferably comprising an axially short resiliently deformable ring 70 and a longer rigid ring 72 that axially extends beyond the core second end 66, as seen in FIG. 8. Stud annular sheaths 72 are preferably made from the same electrically Insulating material as arm sleeves 28, 30.

In use, when lever member 56 is forcibly pivoted in counterclockwise fashion into its lower transverse limit position, its second cam end 56*c* will pivotally abut about pivot axle 57 against the upper end portion 24*c* of second arm member 24, correspondingly pivoting the latter from its second to its first limit position against the action of coil springs 38, 40. Lever 56, in its lower limit position, can be released without it pivoting back to its upper limit position, because of the stable and flat engagement of its cam finger 56*c* on arm member 24; it is only when the lever 56 occupies a position intermediate its top and bottom positions that cam

56*c* is unstable against arm 24*c*. Therefore, operations on and around holding clamp 18 can be accomplished while its jaws 22*a*, 24*a* are opened without having to manually hold them forcibly in their opened position. While second arm member 24 is in its first ("opened") limit position, an article 20 to be plated may be manually inserted between the spread-apart studs 58 and 60. Lever 56 can then be manually pivoted back into its upper limit position, coil springs 38, 40 correspondingly biasing second arm member 24 into its second ("closed") limit position. Studs 58, 60 will coaxially endwisely engage article 20 with their washers 68, the deformable ring 70 thereof yieldingly compressing itself and allowing rigid ring 72 to axially slide towards stud outer first end 64, until the second end 66 of core 62 is released for flat abutment thereof with its second end 66 against the article 20 surface. Thus, washers 68 sealingly axially engage the surfaces of the plate 20, to prevent acid from leaking between washers 68 and plate 20, which would result in core 62 being reached and corroded by the acid solution when it is submerged therein.

First terminal stud 58 acts as conduction means for conducting the electrical current from arm member 22 to article 20. For purposes of production uniformity and of product reliability to the electrically non-knowledgeable consumers, second stud 60 may be identical to first stud 58.

Of course, it is understood that other shapes of the lower ends 22*b*, 24*b* of arm members 22, 24 could circumvent the use of studs 58, 60, without extending beyond the scope of the present invention.

Once studs 58, 60 have engaged plate 20, the latter is frictionally taken in sandwich between studs 58, 60. The lower portion of clamp 18 may then be inserted into the acid solution 12 for electroplating of article 20. The lower portion of the arm members 22, 24 is completely sealed off from the the ambiant acid solution, by sleeves 28, 30 and stud washers 68. This prevents the arm members metallic body and the stud core 62 from being electro-plated in the acid solution.

It is noted that throughout this application, reference has been made to fluid-tight material concerning the arm member sleeves and the stud washers. It is understood that these fluid-tight materials must be fluid-tight against acid solutions most of all, and thus must resist to corrosive environments. Suitable known plastic materials are preferred.

Preferably, a fluid-tight film layer 74 (FIG. 8) coats the cylindrical peripheral outer surface of stud core 62. The combination of film 74 and washer 68 will significantly assist in preventing plating of stud core 62 and thus in extending useful operational lifetime thereof. Washer 68 could allow acidic liquid to accidentally seep through a crack therein towards core 62, and this is why film 74 has been adapted to prevent contact of the acidic liquid on core 62. However, washer 68 is necessary, even with fluid-tight coating 74, for two reasons:

1) it shields film coating 74 from scratches and from being partially removed from core 62 during manipulations thereabout, especially when article 20 is installed/removed from clamp 18; and
2) it seals the electrically-conducting engagement of stud core 62 on article 20, as described above.

A preferred material for the film coating 74 is sold under the trademark HALAR.

Washer 68 further has another important advantage, in that it is easily replaceable. Indeed, it is only slided over freely on stud 62, it is not glued nor otherwise permanently installed over stud core 62, and thus at any time may be replaced by a fresh washer 68. After removing the washer 68 of a stud, the core itself may be unscrewed from its corresponding arm member, and replaced also by a fresh stud core 62.

It is also envisioned that the arm member lower portions 22*a*, 24*a* be replaceable, by providing a bolt attachment of the lower portions 22*a*, 24*a* to the arm member main body, above the sleeves 28, 30. This is desirable in the case that the sleeves themselves become damaged over time.

To have different levels of replaceable parts such as the washers, the stud cores and the arm members lower portions, it is highly desirable to minimize the repair cost in case one or another of these parts becomes damaged, and to minimize the repair time. Indeed, maintenance can be performed in situ, since the parts need only be replaced, and the whole clamp need not be removed from the cathode bar to accomplish these repairs.

A second and most preferred embodiment of the invention is shown in FIGS. 9 to 12.

Figure 11:
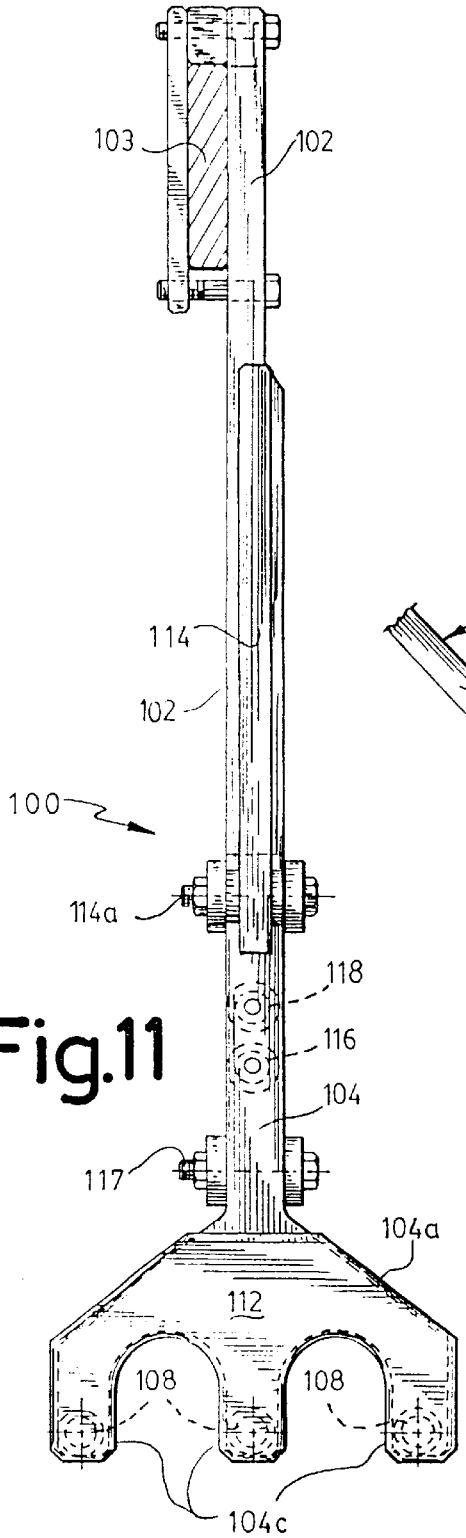
FIG. 11 is a view, at an enlarged scale, of the holding clamp of FIG. 9.
Figure 12:
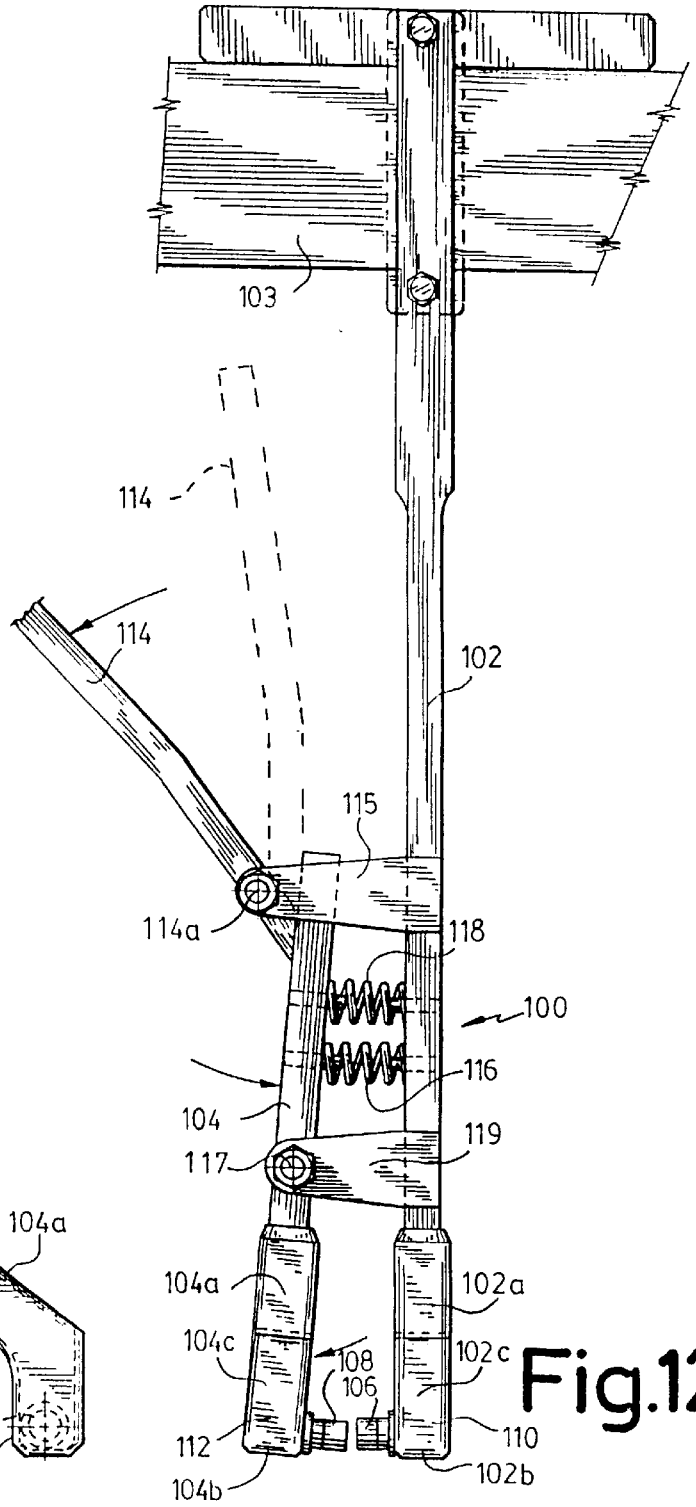
FIG. 12 is a side elevation of the holding clamp of FIG. 11, with the jaws in partly opened spread position, and further suggesting the position of the lever in a closed position in dotted lines.
Figure 13:
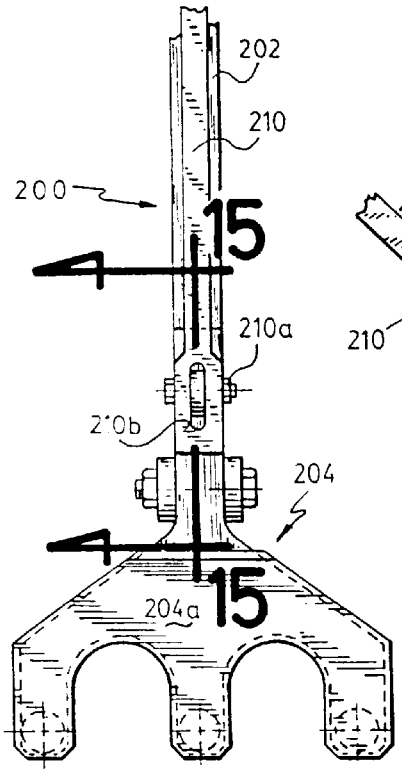
FIG. 13 is a partial front elevation of a third embodiment of the holding clamp of the invention.
Figure 14:
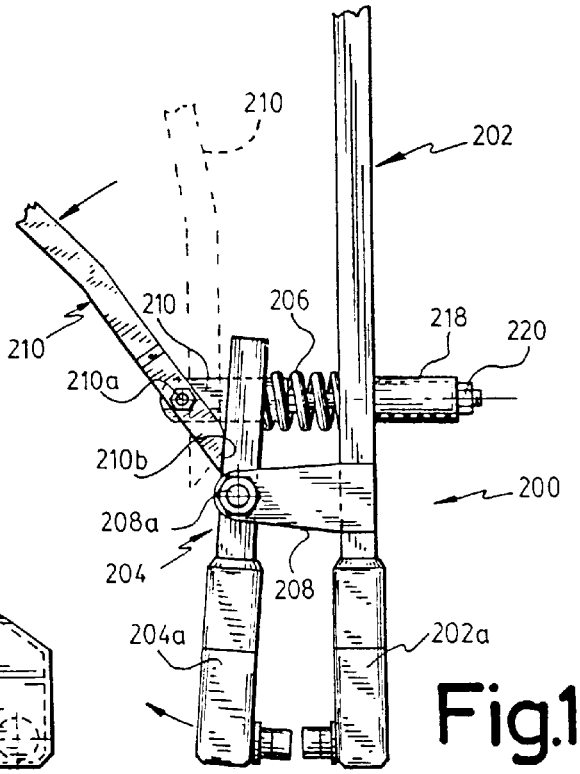
FIG. 14 is a partial side elevation of the holding clamp of the third embodiment, suggesting in phantom lines the play of the holding clamp pivotal lever.
Figure 15:
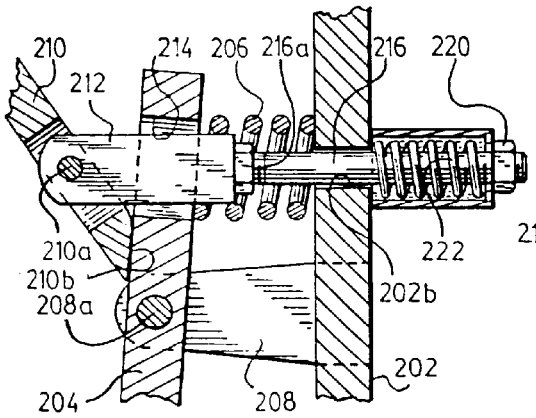
FIG. 15 is a cross-sectional view, at an enlarged scale, taken along line 15—15 of FIG. 13, with the holding clamp lever forcibly brought in its open jaw transverse condition.
Figure 16:
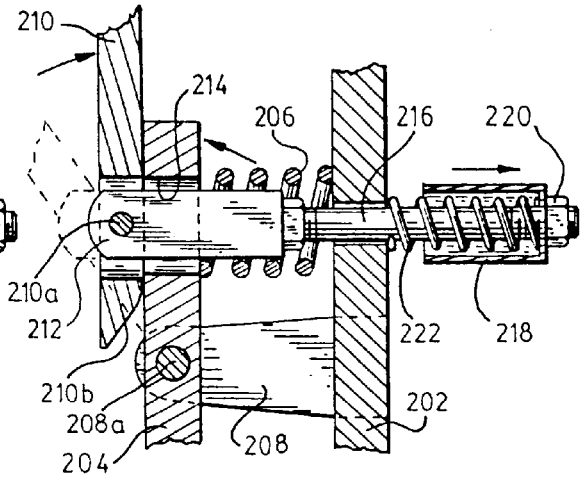
FIG. 16 is similar to FIG. 15, but with the holding clamp lever brought into its closed jaw vertical position, as shown in phantom lines in FIG. 14.

More particularly, FIGS. 11 and 12 show a holding clamp 100 according to this second preferred embodiment. As with the clamp 18 of the first embodiment, clamp 100 comprises a first longer arm member 102 fixed on and downwardly depending from the cathode flight bar 103 and a shorter second arm member 104 pivotally attached to first arm member 102 at intermediate sections thereof. Each arm member defines a lower portion 102*a*, 104*a* and a lower end 102*b*, 104*b*.

In this second embodiment, the arm lower portions 102*a*, 104*a* have three distinct, downwardly extending, spaced-apart fingers 102*c*, 104*c*, each finger 102*c* being equipped with an inwardly oriented first stud 106, and each finger 104*c* being equipped with an inwardly oriented second stud 108. Lower portions 102*a*, 104*a* are enveloped in a fluid-tight, electrically insulating sleeve 110, 112, all fingers 102*c*, 104*c* being covered by its respective sleeve 110, 112 so that lower portions 102*a*, 104*a* will be effectively corrosion-resistant and fluid-tight and electrically insulated when second arm member 104 is in its second closed limit position.

As with the first embodiment of the invention, a lever 114 is used to continuously engage and selectively tilt second arm member 104 from its first opened to its second closed limit position, with coil springs 116, 118 biasing second arm member 104 into its second closed limit position. Lever 114 is pivotally connected at 114*a* to one end of a bracket 115 anchored at its opposite end to arm 102, while arms 102 and 104 are pivotally interconnected at 117 by another bracket 119 parallel to and beneath bracket 115, with coil springs 116, 118 located between brackets 115 and 119.

Figure 9:
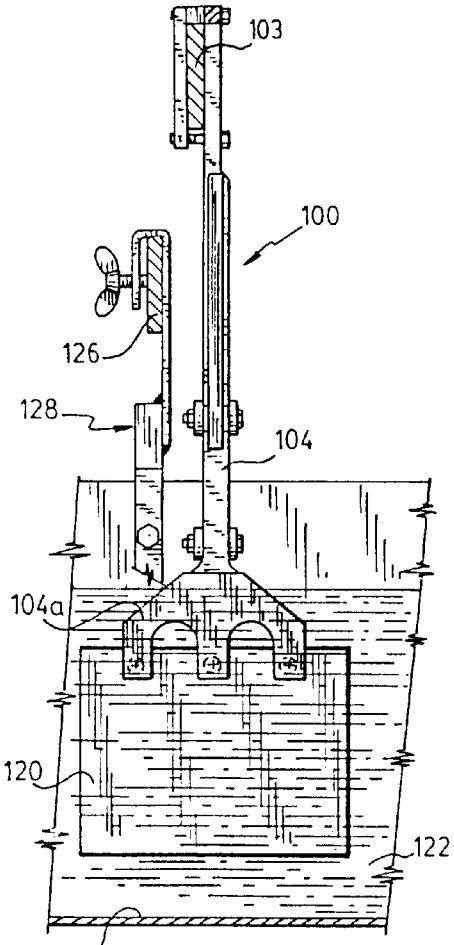
FIG. 9 is a front elevation—sectionally across the flight bar—of a second preferred embodiment of a holding clamp holding a plate article to be plated in an acid bath, suggesting that each circuit board is supported by three distinct pairs of jaws from a holding clamp.

FIG. 9 shows a holding clamp 100 according to this second embodiment of the invention, with its second arm member 104 in its second closed limit position, with an article 120 held by first and second arm members 102, 104. As known in the art, article 120 is fully submerged in an acid solution 122 contained in a bath 124, and thus lower portion 102*a*, 104*a* of arm members 102, 104 are also partially submerged therein.

It can be seen that the holding clamp 100 according to the second preferred embodiment of the invention can be advantageously used to steadfastly hold larger articles 120 to be electroplated, since it can accommodate larger articles than the single-studded clamp 18 of the first embodiment. Not only is the grip of the clamp 100 more stable on the article 120 due to the three retaining points of the three pairs of first and second studs, preventing accidently sidewise tilts of the circuit board 120, but also the electrical current will be more evenly distributed over the article 120 surface, and consequently the electroplating will be more evenly accomplished over the article 120 surface. Indeed, the electrical current is transmitted to the article 120 by first studs 106, thus to have three conducting vectors on the article 120 is better than only one for a larger surface. On smaller articles such as article 20 shown in FIG. 1, this is less important, since the electrical current distribution is not accomplished over a large area. However, over larger articles such as article 120 of FIG. 9, this current distribution must be accomplished over larger areas, and the intrinsic electrical resistance of the article 120 and of the metallic electroplated layer will become more significant than on smaller articles. Therefore, several spaced-apart studs are desirable.

It is understood that a holding clamp with two, three, four, or any suitable number of stud pairs could be used to hold an article to be electroplated. Preferably clamps with more stud pairs are used on larger articles. In any event, it is preferable to use a clamp comprising most preferably at least two pairs of studs at the two opposite top corners of the circuit board panel, and preferably between two and four pairs of studs, since a more stable engagement with the circuit board is achieved.

Figure 10:
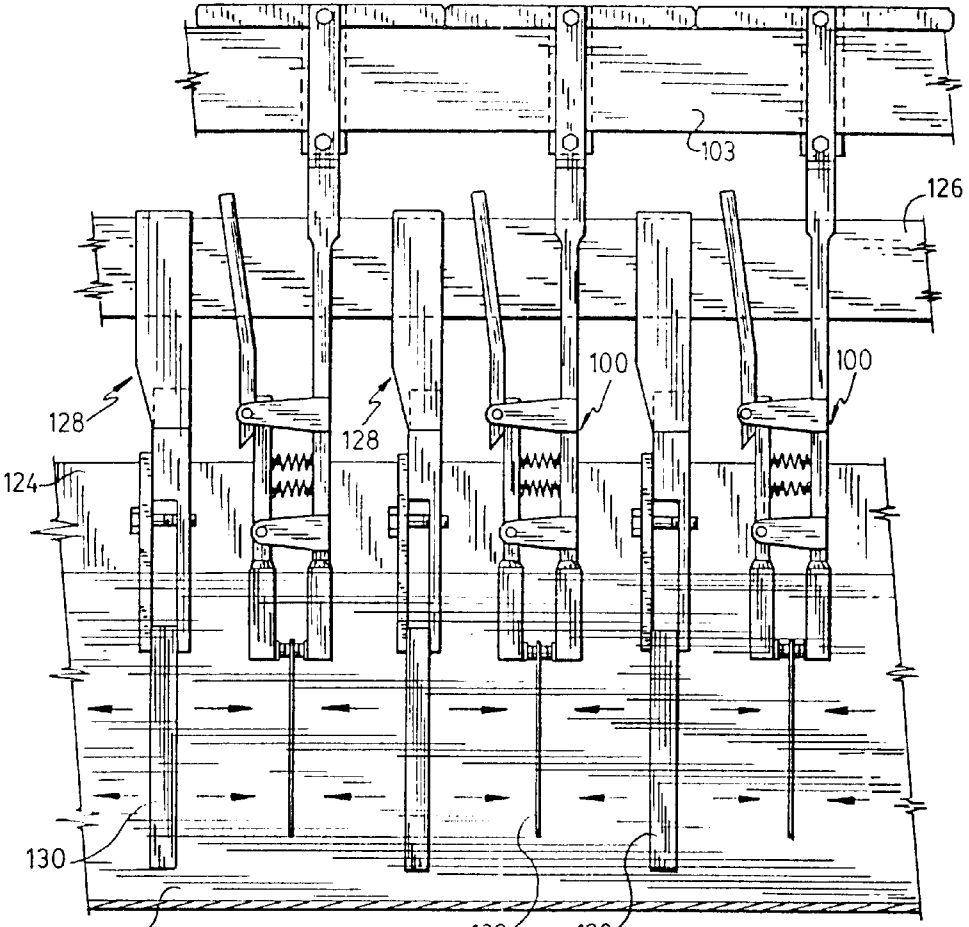
FIG. 10 is a side elevational sectional view of an acid bath, together with a number of alternated holding clamps and anode bars supported into the acid bath spacedly from the bottom wall thereof.

FIG. 10 is a side view of the bath 124 of FIG. 9. It can be seen that a number of holding clamps 100 depend from the main cathode flight bar 103. A second horizontal fixed frame bar 126 is installed spacedly over bath 124 (see also FIG. 9), fixed bar 126 being equipped with a number of clamps 128 downwardly depending therefrom and each holding an anode element 130, preferably in the shape of cylindrical bars. Each flat circuit board 120 to be electroplated has at least two anode elements 130 spacedly facing ahead one of its flat surfaces by a few centimeters, so as to advantageously position these surfaces relative to the migrating metallic positively charged ions.

As with the first embodiment of the invention, the cathode bar 103 and anode bar 126 of the overhanging frame are vertically movable so as to allow the circuit boards 120 to be retrieved from and submerged into bath 124.

FIGS. 13 to 16 show a third embodiment of a holding clamp 200 according to the invention, which is very similar to the second embodiment of the holding clamp 100.

The first and second arm members 202, 204 of holding clamp 200 are biased towards one another through the instrumentality of different biasing means in this embodiment. Indeed, holding clamp 200 has a single coil spring 206 biasing second arm member 204 into its second closed limit position, coil spring 206 still being compressed between first and second arm members 202, 204 and being located above the single lower bracket member 208 (i.e. on the side opposite jaws 202*a*, 204*a*). Intermediate sections of arms 202 and 204 are pivotally interconnected at 208*a* by bracket 208 which is located parallel to and beneath coil spring 206. The second lower end 210*b* of the lever 210 is provided with a U-shaped opening sized to receive one end of a bracket plate 212, which is pivotally carried thereon by a pivot pin at 210*a*, the latter allowing free pivotal movement of lever 210 thereabout. Bracket plate 212 freely extends through an opening 214 in second arm member 204 and is threadingly engaged by a threaded end section of a shaft 216, intermediate first and second arm members 202, 204. Shaft 216 freely extends through a bore 202*b* in arm 202 and beyond first arm member 202, and into a spring casing 218 located adjacent first arm member 202 distally of spring 206. A bolt 220 engages the free extremity of rod 216 to prevent casing 218 from axially sliding off rod 216 under bias of intermediate spring 206. A coil spring 222 is compressed inside spring casing 218 between the casing 218 end wall and first arm member 202, being coaxially installed around the extremity of rod 216.

Coil spring 206 is positioned axially around both bracket plate 212 and the inner section of rod 216.

The purpose of spring 222 is to bias lever member 210 towards its upper vertical limit position, by resting against fixed first arm member 202 and applying pressure on spring casing 218, the latter carrying shaft 216 and integrally connected bracket plate 212 together with the lever pivot pin 210*a* under the force applied by compressed spring 222. It can now be understood that when holding clamp 200 holds a thicker article to be electroplated, the lever 210 will have a tendency to tilt under its own weight from its vertical position in phantom lines in FIG. 14 to its transversely inclined position in full lines in FIG. 14, due to the angle of second arm member 204 relative to a vertical axis, this angle being brought upon by the opening of jaws 202*a*, 204*a*. Spring 222, by indirectly pulling on the lever pivot pin 210*a*, will bias lever member 210 into its upper vertical limit position, and thus prevent same from obstructing the path of the vertically movable flight bar and holding clamp 200 assembly.

Indeed, when holding jaws 202*a*, 204*a* close upon a thick article to be plated, lever 210 will be near its vertical limit position, but may be still at an intermediate position between its lower and its upper limit position, due to the slightly opened position of jaws 202*a*, 204*a*, the more so if the article is very thick. Coil spring 206 will not assist lever 210 to reach its upper vertical limit position beyond this point, since the second arm member lower end 204*a* will abut against the article and will not pivot any further under the bias of spring 206. Spring 222, by pushing against arm 202, will then pull lever 210 by retraction of slidable shaft 216 distally from spring 206. Since shaft 216 and arm 210 are pivotally interconnected at 210*a*, and since arms 204 and 210 are pivotally interconnected at 208*a*, the lever 210 will always automatically straighten itself upright by engaging with its cam end 210*b* the motionless second arm member 204 to achieve this upright position.

The clamp 18 (or 100 or 200) according to the present invention can be used with articles having varying shapes, since its design does not limit the use of the clamp to particular article shapes. Moreover, the article to be plated can have a thickness comprised within a certain relatively wide range. Indeed, any article thickness up to the maximum opening distance of the second arm member relative to the first arm member can be accomodated, without compromising the leakproof interconnections between the studs 58, 60, and the circuit board 120.

The advantages of the present invention over the prior art devices are as follows:

1) the large manual lever 56, 114 is easy to handle by a user for up to four pairs of studs for a given circuit board, since it is not of small size like a screw or the like element, and does not require painful wristwise repetitive rotations of the wrist to operate, as in the case of prior art devices using bolts for fixing the articles on the clamps;
2) the lever is not submerged into the acidic solution, and thus only basic protective gear is needed to manipulate the lever after retrieving the article from the acid solution and no protective sheath is required on the lever itself;
3) only one clamp member needs to be operated to open or close the jaws formed by the two arm members, and thus the time to install/retrieve the articles to be plated is much shorter than with the prior art devices, even in the case where more than one stud holds the article, such as in the second embodiment of the invention; and 4) only one person is required for installing/removing the article to be plated on/from the clamp, since he can hold the article with one hand and operate the lever with his other free hand; many prior art devices, especially those that used bolts or nuts to fix the articles to the frameworks, required one person to hold the article while another person needed both his hands to operate the attachment means.

It is understood that, with a second stud that is electrically conducting, as described in the present application, the lever 56, 114 of the clamp would carry live current, i.e. be negatively charged due to its indirect connection to the cathode bar. However, no safety hazard is to be expected by the human operator by manually grasping lever 56, since the potential difference between the cathode bar and the anode elements is quite small (1 to 2 volts) and this does not represent any electrocution danger to the person manipulating the lever 56, 114 while the power means are activated.

Any other minor alterations that do not deviate from the scope of this invention are considered to be included therein.

I claim:

1. A holding clamp, for releasably holding an article to be submerged in a liquid solution bath ahead of a submerged anode bar and to be electroplated therein, said holding clamp destined to downwardly depend from an overlying cathode frame bar, said holding clamp comprising:

a) a first and a second elongated arm members made from an electrically conducting material and each defining a lower portion coated with a fluid-tight and electrically insulating sleeve, and an upper and a lower end, said first arm member to be fixedly attached to the cathode frame bar at its upper end, said second arm member being shorter than said first arm member and being pivotally attached to said first arm member and being pivotable between a first limit position in which said lower ends are spaced from one another and a second limit position in which said lower ends abut against one another, said first arm member having electrical current conduction means physically accessible at its lower end;

b) biasing means, for biasing said arm members lower ends against one another;

c) a lever member, pivotally attached to an intermediate section of said first arm member and located entirely above said first and second arm member sleeves at all times, said lever member selectively forcibly pivotally biasing said second arm member into said first limit position against the action of said biasing means;

wherein said first and second arm members are destined to frictionally hold the article to be electroplated between their lower ends when said second arm member is in its second limit position, thus allowing current to be conducted through said conduction means into said article, with said first and second arm member lower portions destined to be submerged in the solution so that said sleeves be only partially submerged.

2. A holding clamp as defined in claim 1, wherein said conduction means includes at least a first terminal stud having an electrically conducting core defining a first and a second end, said core first end extending through said first arm member sleeve and being electrically connected to said first arm member electrically conducting material, said terminal stud further having a fluid-tight and electrically insulating washer member snugly sealing said core except at said first and second ends, with said washer member axially extending beyond said second end and being destined to be sealingly axially compressed against the article when said second arm member is in said second limit position, but allowing said stud core second end to engage said article for electrical connection therebetween.

3. A holding clamp as defined in claim 2, wherein said second arm member further includes a second cylindrical stud axially registering with said first stud when said second arm member is in said second limit position, with said second stud having an outer washer member to be axially compressed against the article when said second arm member is in said second limit position.

4. A holding clamp as defined in claim 3, wherein said first stud is cylindrical and has an electrically-resistant and corrosion-resistant film coating its cylindrical surface under said washer member.

5. A holding clamp as defined in claim 3, wherein said first arm member further has several first terminal studs and said second arm member has an equal number of second terminal studs each coaxially engaging with a corresponding first stud when said second arm member is in its said second limit position.

6. A holding clamp as defined in claim 1, wherein said first and second arm members are pivoted by means of a first mount fixedly attached to said first arm member above said sleeve, said second arm member being pivotally attached to said pivoting mount spaced from said first arm member, said biasing means being at least one coil spring compressed between and attached to intermediate sections of said first and second arm members, said coil spring being located between said first mount and said first and second arm member upper ends.

7. A holding clamp as defined in claim 6, wherein said lever defines a first and a second end and is attached to said first arm member by means of a second mount fixed to said first arm member, with said lever being pivotally attached to said second mount spaced from said first arm member and at a location intermediate said lever first and second ends, said lever being pivotable between a lower and an upper limit position corresponding to said second arm member first and second limit position, respectively, said lever second end lying freely adjacent said second arm member in its upper limit position and pivotally abutting against said second arm member above said at least one coil spring when pivoted into its lower limit position.

8. An electroplating assembly for electroplating an article in a liquid acid bath, including a rigid frame to overhang the bath and vertically selectively movable between a lower and an upper limit position, at least one holding clamp for releasably holding the article to be submerged in the liquid solution, said holding clamp being fixedly anchored to said frame on a cathode bar and downwardly depending therefrom, at least one anode element located on each side of said holding clamp when said frame is in its lower limit position, power means electrically connected to said anode element and to said frame for obtaining a selected potential difference therebetween, said holding clamp comprising:

a) a first and a second elongated arm members made of an electrically conducting material and each defining a lower portion coated with a fluid-tight and electrically insulating sleeve, and an upper and a lower end, said first arm member being fixedly attached to said frame cathode bar at its upper end, said second arm member being pivotally attached to said first arm member and being pivotable between a first limit position in which said lower ends are spaced from one another and a second limit position in which said lower ends abut against one another, said first arm member having electrical current conduction means physically accessible at its lower end;

b) biasing means, for biasing said second arm member to its second limit position;

c) a lever member, pivotally attached to said first arm member and located entirely above said first and second arm member sleeves at all times, said lever member selectively forcibly pivotally abutting against said second arm member for forcibly biasing said second arm member into said first limit position against the action of said biasing means;

wherein said first and second arm members are destined to frictionnally hold the article to be electroplated between their lower ends when said second arm member is in its second limit position, and wherein said article is destined to be submerged into said liquid acid solution when said frame is in said lower limit position, thus allowing current to be conducted through said first arm member, said conduction means, said article and said liquid solution, with said first and second arm member lower portions destined to be submerged in the solution.

9. A holding clamp as defined in claim 8, wherein said conduction means is at least a first cylindrical stud having an electrically conducting core defining a first and a second end, said core first end extending through said first arm member sleeve and being electrically connected to said first arm member electrically conducting material, said stud further having a fluid-tight and electrically insulating washer member snugly sealing said core except at said first and second ends, with said washer member axially extending beyond said second end and being destined to be sealingly axially compressed against the article when said second arm member is in said second limit position, but allowing said stud core second end to engage said article for electrical connection therebetween.

10. A holding clamp as defined in claim 9, wherein said first arm member further has several first studs and said second arm member has an equal number of second studs each axially registering with a corresponding first stud when said second arm member is in its said second limit position.

11. An assembly of at least two clamp members to be combined with a single cathode flight bar in supporting a single article to be plated inside an acid bath and ahead of a submerged anode bar during an electroplating process, wherein each of said clamp members comprises:

a) first and second rigid elongated arms, at least said first elongated arm being made from an electrically conducting material, each of said arm defining a pair of jaws at inner ends thereof and opposite outer end portions, each of said jaws being shielded from acid fluid by a protecting sheath;

b) anchor means for releasably anchoring said first arm outer end portion to the cathode flight bar, so that said jaws downwardly depend therefrom;

c) a pair of terminal studs, transversely inwardly projecting from said inner end jaws integral thereto and each defining a free outer end, at least said first arm stud including shielding means for shielding against acid corrosion and mechanical abrasion inside the acid bath, wherein at least said terminal stud of said first arm is electrically connected to said first arm;

d) first pivot means, pivotally interconnecting intermediate sections of said first and second arms so that said first and second arms remain in spaced generally parallel fashion, wherein said studs generally point toward one another;

e) biasing means, carried by said arms and acting on said arms for biasing said terminal studs toward and against one another coaxially thereof, wherein circuit boards of variable thickness can be frictionally taken in sandwich between said studs in releasable fashion and in equally effective fashion independently of the thickness of the circuit board;

f) compressible sealing means, cooperating with said biasing means and with said stud shielding means in preventing accidental acid fluid leakage around said shielding means and toward said first arm stud when the circuit board is inside the acid bath and sandwiched between the studs under bias from said biasing means, while authorizing free electrical conduction between said first arm stud free outer end and the circuit board; and g) manual release means, for progressively releasing said studs from one another against the bias of said biasing means; wherein said release means of all of said at least two clamp members can be operated concurrently and single-handedly by a sole operator.

12. An assembly of clamp members as defined in claim 11, wherein said first arm is longer than said second arm and both first and second arms are tubular, and wherein said release means includes:

a) an elongated handle bar, having a first and a second end portions, the latter end portion engageable by an operator's hand, a cam transversely carried by said handle bar first end portion; and b) second pivot means, pivotally interconnecting said handle bar first end portion to an intermediate section of said first arm in spaced transverse fashion, with said handle bar first end portion frictionally engaging said second arm outer end portion about a wall section thereof opposite said first arm;

wherein said handle bars of said at least two clamp members are in close spaced register with one another so that all said handle bars second end portions can be grasped by the same hand of the operator;

and wherein each of said handle bars is manually pivotable about said second pivot means between a first limit position, in which said cam member forcibly engages said second arm to spread apart said jaws to release said studs from one another against the bias of said biasing means, and a second limit position, in which said cam member releases said second arm to bring said studs against one another yieldingly under bias from said biasing means.

13. An assembly of clamp members as defined in claim 12, wherein said biasing means consists of a pair of coil springs transversely interconnecting an intermediate section of said first and second arms in between said first and second pivot means, said coil springs being spaced from one another lengthwisely of said arms.

14. An assembly of clamp members as defined in claim 11, wherein each of said studs is of cylindrical shape and is covered on all its cylindrical surface by a layer of protective electrically-resistant and corrosion-resistant coating.

15. An assembly of clamp members as defined in claim 11, wherein said manual release means includes:

an elongated lever having a cam end portion and a handle end portion opposite said cam end portion; an elongated shaft, extending freely through said second arm outer end portion and through an intermediate section of said first arm; and a pivot mount, pivotally interconnecting said lever cam end portion and an adjacent end of said shaft;

wherein the first-mentioned biasing means includes a first coil spring member, extending transversely between said arms and surroundingly mounted around an intermediate section of said shaft, wherein said cam end portion frictionally engages the distal wall of said second arm relative to said first arm; and further including second coil spring member, surroundingly mounted around an end portion of said shaft opposite said lever and fixedly anchored thereto by securing means at the shaft latter end so that said second coil spring member abut compressingly against the distal wall of said first arm relative to said second arm;

wherein upon manual release of said handle end portion after a thick article to be plated has been frictionally taken in sandwich between said terminal studs, said lever automatically straightens itself upright under loading from said second coil spring member.

* * * * *